US011484145B2

(12) United States Patent
Tan

(10) Patent No.: US 11,484,145 B2
(45) **Date of Patent: *Nov. 1, 2022**

(54) CURTAIN MOUNTING BRACKET

(71) Applicant: NINGBO LIYANG NEW MATERIAL COMPANY LIMITED, Ningbo (CN)

(72) Inventor: Baowen Tan, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/820,851

(22) Filed: Mar. 17, 2020

(65) Prior Publication Data

US 2020/0305628 A1 Oct. 1, 2020

(30) Foreign Application Priority Data

Mar. 25, 2019 (CN) ..... 201920385659.1

(51) Int. Cl.
*A47H 1/14* (2006.01)
*A47H 1/02* (2006.01)

(52) U.S. Cl.
CPC ..... *A47H 1/14* (2013.01); *A47H 1/02* (2013.01)

(58) Field of Classification Search
CPC . A47H 1/142; A47H 1/14; A47H 1/02; A47H 1/10; A47H 1/104; A47H 1/144; E06B 9/42; E06B 9/40; E06B 2009/407; A14H 1/102
See application file for complete search history.

(56) References Cited

U.S. PATENT DOCUMENTS 4,848,432 A * 7/1989 Connolly ..... E06B 9/174 403/44
5,421,059 A * 6/1995 Leffers, Jr. ..... A47H 15/04 362/253
7,549,615 B2 * 6/2009 Shevick ..... E06B 9/323 248/200.1
8,479,932 B2 * 7/2013 Carney ..... A47H 1/022 211/105.5
9,328,906 B1 * 5/2016 Bennington ..... F21V 23/04
9,670,722 B1 * 6/2017 Hall ..... E06B 9/323
9,926,740 B2 * 3/2018 Pham ..... E06B 9/42
(Continued)

FOREIGN PATENT DOCUMENTS

CN 211974833 U * 11/2020
DE 4200422 A1 * 7/1993 ..... E06B 9/40
(Continued)

*Primary Examiner* — Kimberly T Wood
(74) *Attorney, Agent, or Firm* — W&K IP

(57) ABSTRACT

The present disclosure discloses a curtain mounting bracket, comprising a body, and the body is provided with a first connecting chamber where a hole-free mounting component is installed and a second connecting chamber where a traditional curtain is connected. With the structure of the first connecting chamber where a hole-free mounting component is installed, a bracket can be installed on a wall without any holes, and with the structure of the second connecting chamber, a traditional curtain is connected, thereby solving the technical problem in hole-free mounting of the traditional curtain, assisting the traditional curtain in achieving hole-free mounting and preventing the traditional curtain from being scrapped due to poor sales, thus reducing resource wastes, lowering production cost and achieving quick and convenient assembly and disassembly.

11 Claims, 7 Drawing Sheets

(56) References Cited

U.S. PATENT DOCUMENTS

| | | | | |
|---|---|---|---|---|
| 10,138,676 | B2 * | 11/2018 | Bohlen | E06B 9/50 |
| 10,597,938 | B2 * | 3/2020 | Tan | E06B 9/42 |
| 2008/0245940 | A1 * | 10/2008 | Brown | A47H 1/022 248/251 |
| 2009/0205791 | A1 * | 8/2009 | Sans Folch | A47H 15/02 160/368.1 |
| 2009/0242143 | A1 * | 10/2009 | Pham | E06B 9/40 160/133 |
| 2010/0218906 | A1 * | 9/2010 | Marzilli | A47H 1/104 160/368.1 |
| 2014/0086676 | A1 * | 3/2014 | Coker | E06B 9/323 403/326 |
| 2017/0362889 | A1 * | 12/2017 | Hall | F16B 2/04 |
| 2018/0238107 | A1 * | 8/2018 | Hall | H04Q 9/00 |
| 2019/0162023 | A1 * | 5/2019 | Tan | A47H 1/12 |
| 2020/0037803 | A1 * | 2/2020 | Sapmaz | A47H 99/00 |

FOREIGN PATENT DOCUMENTS

| | | | | |
|---|---|---|---|---|
| DE | 9417613 | U1 * | 2/1995 | |
| DE | 19802742 | A1 * | 7/1999 | A44C 5/2009 |
| DE | 29905543 | U1 * | 7/1999 | A47H 1/104 |
| DE | 102009014536 | A1 * | 9/2010 | A47H 1/144 |
| DE | 202016003952 | U1 * | 5/2017 | |
| DE | 202016105076 | U1 * | 12/2017 | E06B 9/42 |
| KR | 100443449 | B1 * | 8/2004 | |
| KR | 20130003297 | U * | 6/2013 | |
| WO | WO-9932021 | A1 * | 7/1999 | A47H 1/104 |

* cited by examiner

CURTAIN MOUNTING BRACKET

CROSS-REFERENCE TO RELATED APPLICATIONS

This application claims priority to Chinese Patent Application No. 201920385659.1 with a filing date of Mar. 25, 2019. The content of the aforementioned applications, including any intervening amendments thereto, are incorporated herein by reference.

TECHNICAL FIELD

The present disclosure relates to the technical field of curtain accessories, in particular to a curtain mounting bracket.

BACKGROUND

When a traditional curtain is mounted, it requires to perforate at the positions to be mounted in advance before the curtain is secured to the perforated positions. Apparently, the mounting steps is relatively inconvenient in assembly and disassembly since an auxiliary tool is necessary in pre-perforation, and further cleaning is required as a result of wastes generated during perforation. Besides, the perforation operation may damage the initial decoration or building structure, and the holes perforated are not likely to be used again after disassembly and look unsatisfying in appeal. There are also plenty of hole-free mounting curtains emerged on the market, with the structure design completely different from that of traditional curtains, saving the perforating process during installation. As the new curtains with the structure completely substituting for that of the traditional curtains have gained more and more popularity, the traditional curtains are caught in an unsalable situation, and further result in resource wastes. Therefore, it's ideal to achieve a hole-free mounting for traditional curtains, which is to say, by means of a hole-free mounting of traditional curtains, the perforation and damage to a building structure is avoided, the traditional curtains are upgraded, and resource wastes reduced.

SUMMARY

One objective of the present disclosure is to overcome the shortcomings of the prior arts by providing a curtain mounting bracket, to achieve a hole-free curtain mounting, and can be adapted to traditional curtains to avoid unnecessary waste of resources.

The technical solution of the present disclosure is as follows: a curtain mounting bracket, comprising a body, and the body is provided with a first connecting chamber where a hole-free mounting component is installed and a second connecting chamber where a traditional curtain is connected.

In one embodiment, the first connecting chamber penetrates through the body along the length direction of the body.

In one embodiment, the second connecting chamber penetrates through the body along the length direction of the body.

In one embodiment, the second connecting chamber is provided with an elongated slot at the bottom, and the elongated slot penetrates through both ends of the second connecting chamber along the length direction of the second connecting chamber.

In one embodiment, the elongated slot has a width less than that of the second connecting chamber.

In one embodiment, the second connecting chamber is provided with at least one track groove for screw installation at the bottom, and the track groove penetrates through both ends of the second connecting chamber along the length direction of the second connecting chamber.

In one embodiment, two track grooves are provided at two sides of a central line of the second connecting chamber symmetrically.

In a further embodiment, the hole-free mounting component comprises: a connecting base, of which the rear end surface is inwardly provided with an accommodation cavity, the front end surface is inwardly provided with a mounting hole communicated with the accommodation cavity, and the periphery has a plurality of convex ridges extending along the length direction for insertion into the first connecting chamber; a telescopic tube of which the periphery has external threads and the front end stretches into the accommodation cavity; an elastic element accommodated in the accommodation cavity, with its two ends abutting against the front end of the telescopic tube and the inner bottom surface of the accommodation cavity separately; a locking ring that is of an annular shape and sheathes the periphery of the telescopic tube, the inner sidewall of a central through hole of the locking ring is provided with internal threads meshed with the external threads; and a mounting plate connected to the rear end of the telescopic tube.

In a further embodiment, two sliding grooves communicated with the accommodation cavity, are provided at the periphery of the connecting base along the length direction. The two sliding grooves are arrayed in symmetry. There are two sliders that are matched with the sliding grooves in shape and opposite to the sliding grooves, at the periphery of the front end of the telescopic tube. The two sliders are embedded into the sliding grooves respectively.

In a further embodiment, a bi-lug structure is provided on the rear end surface of the telescopic tube. Two square grooves are formed on the mounting plate in a penetrated manner. Two lugs of the bi-lug structure stretch into the square grooves and are hinged with the mounting plate through a pin roll.

As compared to the prior art, the curtain mounting bracket provided in the present disclosure has the advantages that with the structure of the first connecting chamber where a hole-free mounting component is installed, a bracket can be installed on a wall without any holes, and with the structure of the second connecting chamber, a traditional curtain is connected, thereby solving the technical problem in hole-free mounting of the traditional curtain, assisting the traditional curtain in achieving hole-free mounting and preventing the traditional curtain from being scrapped due to poor sales, thus reducing resource wastes, lowering production cost and achieving quick and convenient assembly and disassembly.

Figure 1:
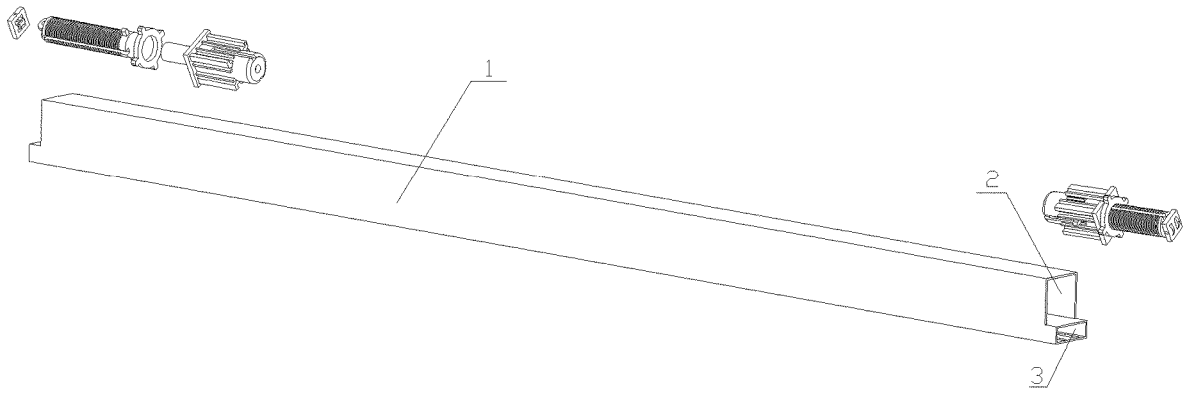
FIG. 1 is a schematic structural diagram of an embodiment of the present disclosure.

The reference numerals denote that: 1 body; 2 first connecting chamber; 3 second connecting chamber; 4 elongated slot; 5 track slot; 6 connecting base; 7 telescopic tube; 8 elastic element; 9 locking ring; 10 mounting plate; 11 accommodation cavity; 12 mounting hole; 13 convex ridge; 14 sliding groove; 15 slider; 16 bi-lug structure; 17 square groove; 18 sliding part; 19 connector; 20 fixing part.

EMBODIMENTS

As shown in FIGS. 1-6, a curtain mounting bracket comprises a body 1, and the body 1 is provided with a first connecting chamber 2 where a hole-free mounting component is installed and a second connecting chamber 3 where a traditional curtain is connected. The first connecting chamber 2 penetrates through the body 1 along the length direction of the body 1. The second connecting chamber 3 penetrates through the body 1 along the length direction of the body 1. The hole-free mounting component is inserted into two ends of the first connecting chamber 2, and it comprises: a connecting base 6 of which the rear end surface is inwardly provided with an accommodation cavity 11, the front end surface is inwardly provided with a mounting hole 12 communicated with the accommodation cavity 11, and the periphery has a plurality of convex ridges 13 that extend along the length direction for insertion into the first connecting chamber 2; a telescopic tube 7 of which the periphery has external threads and the front end stretches into the accommodation cavity 11; an elastic element 8 accommodated in the accommodation cavity 11, with its two ends abutting against the front end of the telescopic tube 7 and the inner bottom surface of the accommodation cavity 11 separately; a locking ring 9 that is of an annular shape and sheathes the periphery of the telescopic tube 7, and the inner sidewall of a central through hole of the locking ring 9 is provided with internal threads meshed with the external threads; a mounting plate 10 connected to the rear end of the telescopic tube 7. Two sliding grooves 14 communicated with the accommodation cavity 11 are provided at the periphery of the connecting base 6 along the length direction. The two sliding grooves 14 are arrayed in symmetry. Two sliders 15 that are matched with the sliding grooves 14 in shape and opposite to the sliding grooves 14 are provided at the periphery of the front end of the telescopic tube 7. The two sliders 15 are embedded into the sliding grooves 14 respectively so as to limit two extreme positions for the telescopic tube 7 moving along the length direction and meanwhile prevent the telescopic tube 7 from disconnecting with the connecting base 6. A bi-lug structure 16 is provided on the rear end surface of the telescopic tube 7. Two square grooves 17 are formed on the mounting plate 10 in a penetrated manner. Two lugs of the bi-lug structure 16 stretch into the square grooves 17 and are hinged with the mounting plate 10 via a pin roll so as to render the mounting plate 10 rotate relative to the telescopic tube 7 and further adapt to an uneven wall surface. Preferably, the elastic element 8 is a spring.

Figure 3:
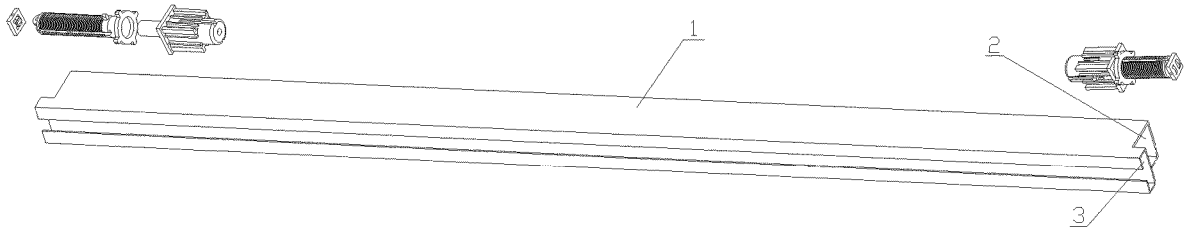
FIG. 3 is a schematic structural diagram of another embodiment of the present disclosure.
Figure 4:
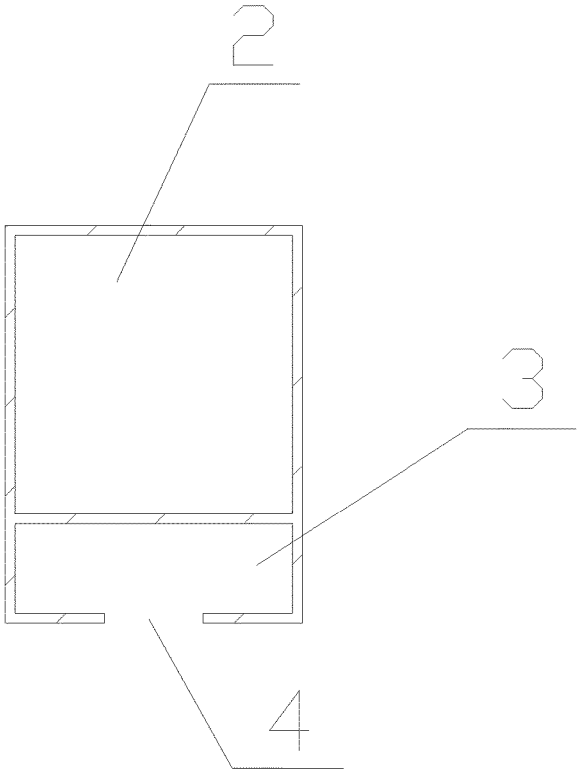
FIG. 4 is a sectional view of another embodiment of the present disclosure.
Figure 5:
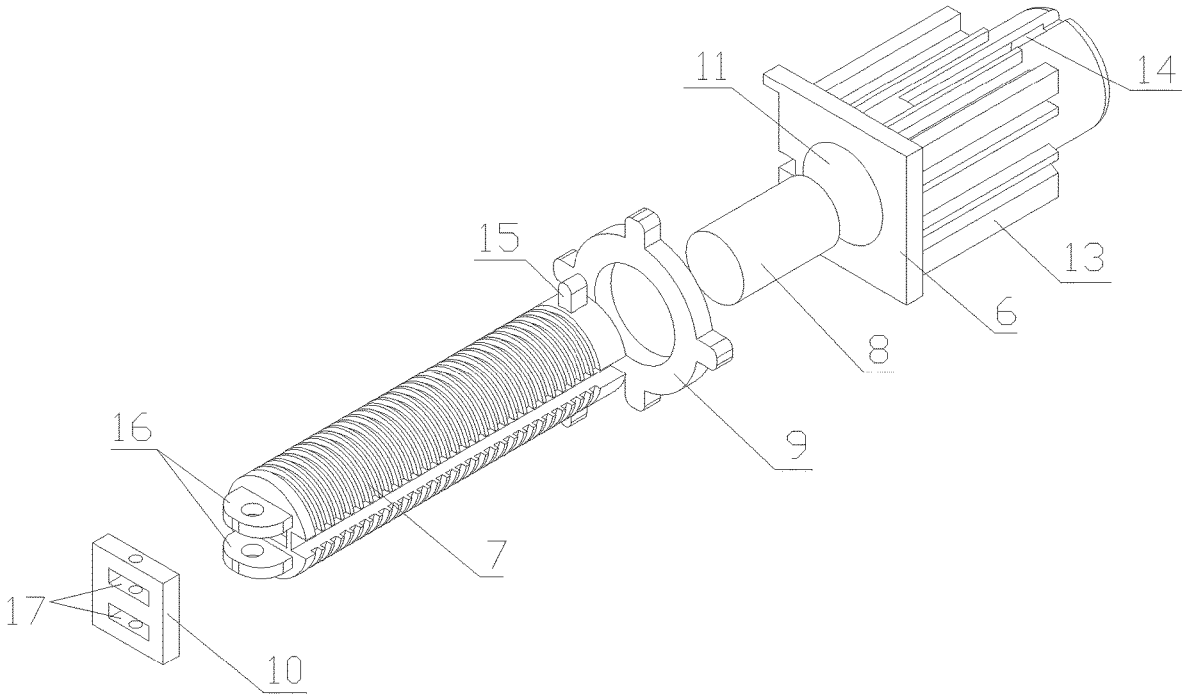
FIG. 5 is an exploded view of a hole-free mounting component of the present disclosure.
Figure 6:
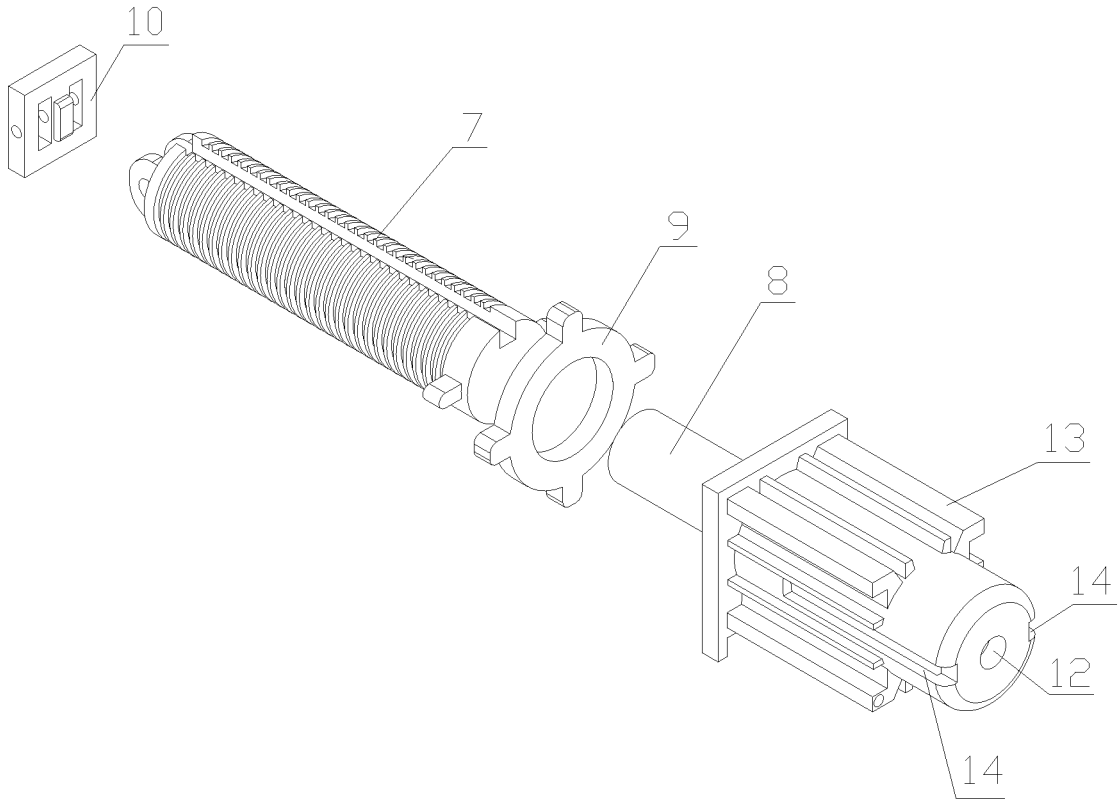
FIG. 6 is an exploded view of the hole-free mounting component of the present disclosure (viewed from another angle)
Figure 7:
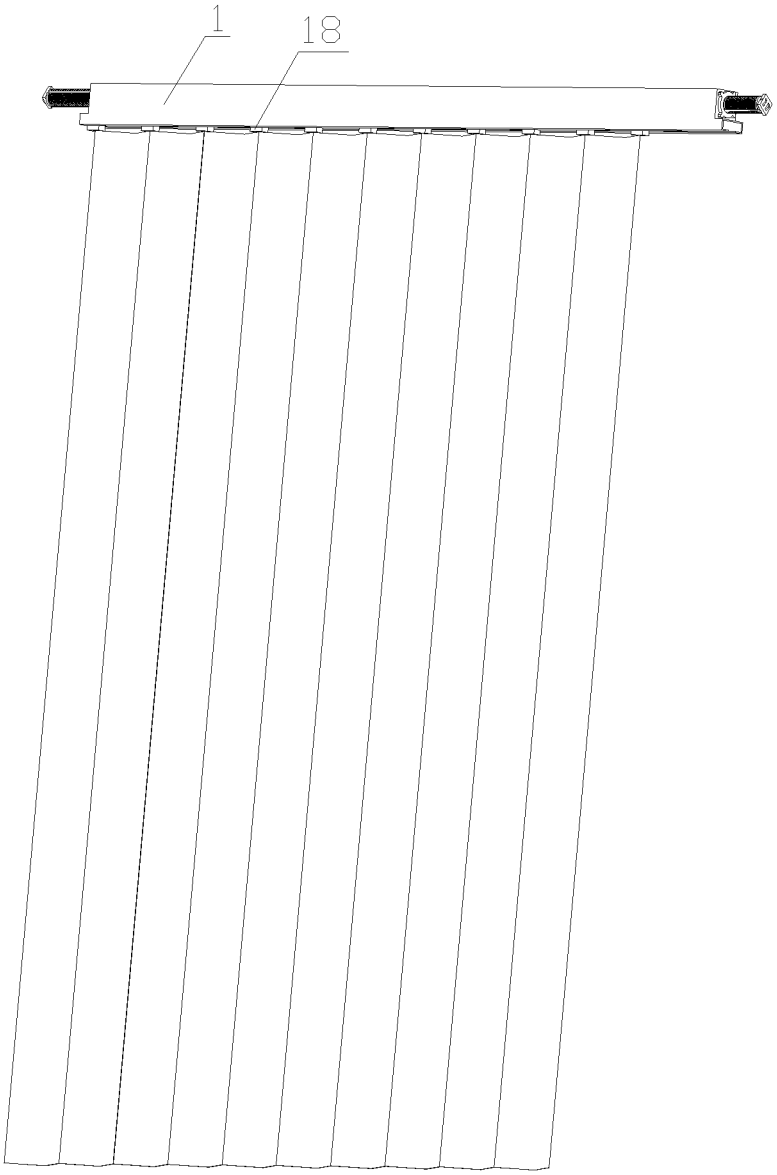
FIG. 7 is a schematic structural diagram of a specific use of another embodiment of the present disclosure.

In a preferred embodiment, as shown in FIGS. 3-4, the second connecting chamber 3 is provided with an elongated slot 4 at the bottom, and the elongated slot 4 penetrates through two ends of the second connecting chamber 3 along the length direction of the second connecting chamber 3. The elongated slot 4 has a width less than that of the second connecting chamber 3. The above structure may be adaptively connected to a traditional fabric curtain the upper end of which has a plurality of sliding parts 18 for opening or closing the curtain in a horizontal sliding manner. The second connecting chamber 3 may be slidably connected to the sliding parts 18 such that the sliding parts 18 are capable of horizontally sliding in the second connecting chamber 3. By means of the elongated slot 4, the lower ends of the sliding parts 18 penetrate out to be connected with the curtain, thereby achieving hole-free mounting of the traditional fabric curtain (as shown in FIG. 7).

Figure 2:
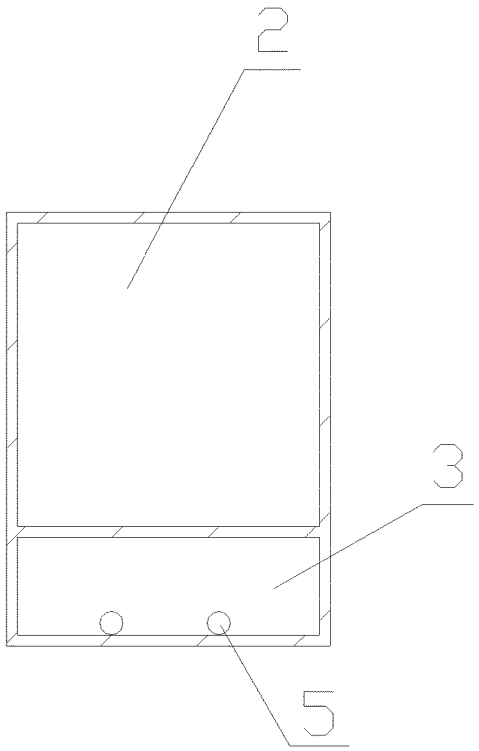
FIG. 2 is a sectional view of the embodiment of the present disclosure.
Figure 8:
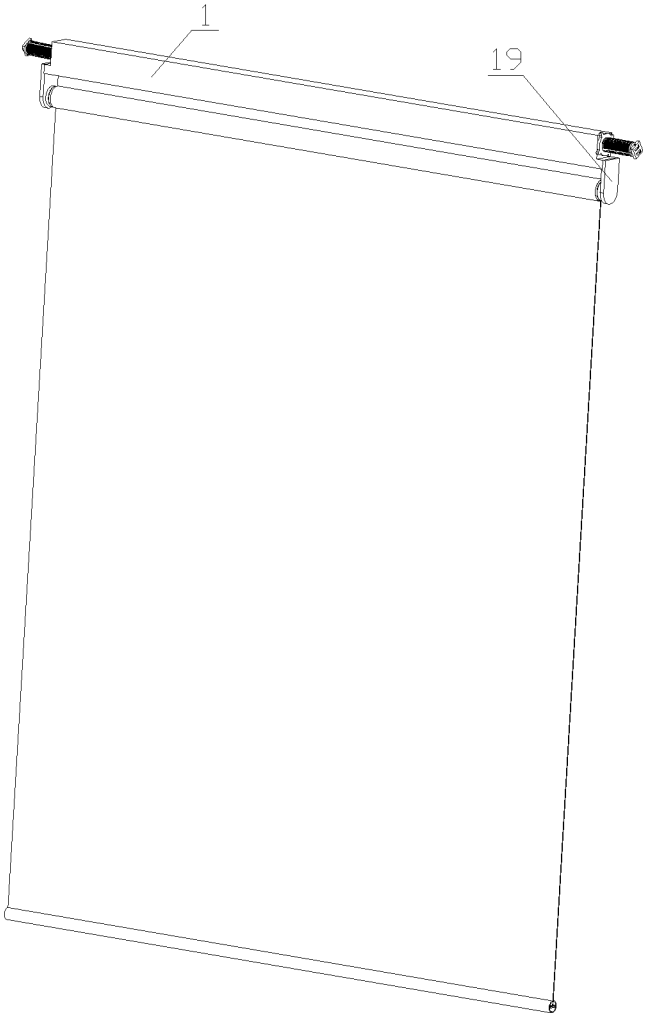
FIG. 8 is a schematic structural diagram of a specific use of the embodiment of the present disclosure.
Figure 9:
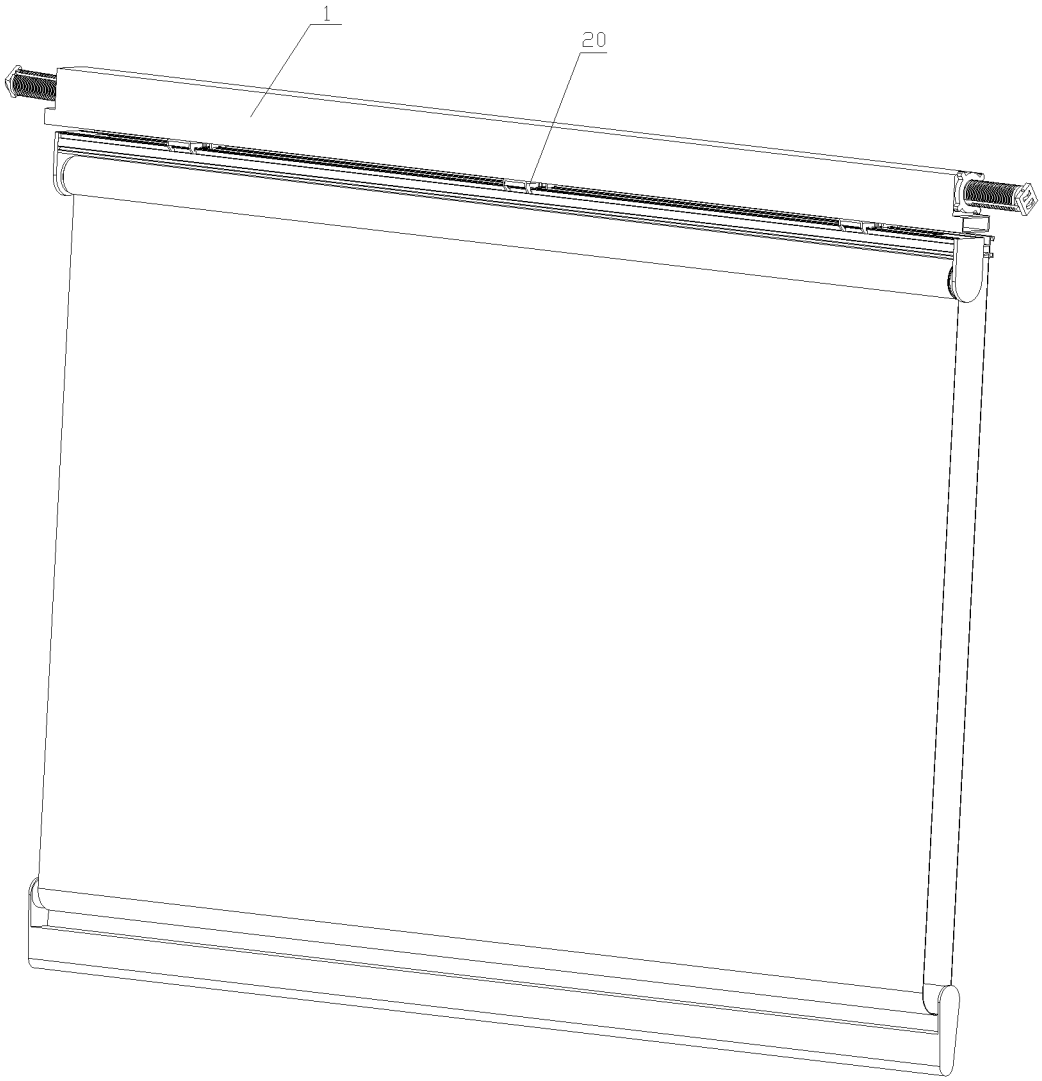
FIG. 9 is another schematic structural diagram of a specific use of the embodiment of the present disclosure.

In a preferred embodiment, as shown in FIGS. 1-2, the second connecting chamber 3 is provided with at least one track groove 5 for screw installation at the bottom, and the track groove 5 penetrates through two ends of the second connecting chamber 3 along the length direction of the second connecting chamber 3. Preferably, two track grooves 5 are provided at two sides of a central line of the second connecting chamber 3 in symmetry. The above structure may be adaptively connected to a traditional roller shutter of which two ends are inserted with connectors 19 for being connected to a wall body. Arrangement of the second connecting chamber 3 enables insertion of the connectors 19. The connectors 19 can be inserted into two ends of the second connecting chamber 3 and then fixed by screwing screws in the track groove 5 so as to fixedly connect the traditional roller shutter with the second connecting chamber 3, thereby achieving hole-free mounting of the traditional roller shutter (as shown in FIG. 8). The above structure may also be adaptively connected with a complicated traditional curtain having a top rod, and the top rod of the traditional curtain is elastically buckled with fixing parts 20 for being connected to a wall body. Arrangement of the second connecting chamber 3 enables connection of the fixing parts 20. The fixing parts 20 are fixed at the bottom of the second connecting chamber 3 by screws and then the top rod is buckled on the fixing parts 20, such that the traditional curtain is mounted on the bottom of the second connecting chamber 3, thereby achieving hole-free mounting of the traditional curtain (as shown in FIG. 9).

During mounting, the hole-free mounting component is first inserted to two ends of the first connecting chamber 2, then the curtain to be mounted is assembled at the second connecting chamber 3, and then merely by pressing the front end of the telescopic tube 7 in the hole-free mounting component into the accommodating cavity 11, the telescopic tube 7 is released after the positions to be mounted are determined, under the effect of the elastic element 8, the rear end of the telescopic tube 7 moves backward to abut against the wall body, at this moment, the locking ring 9 is screwed to the front end to abut against the rear end of the connecting base 6, so as to effectively prevent the telescopic tube 7 from retracting into the accommodating cavity 11, i.e., the mounting operation is finished conveniently and rapidly without any holes.

In the present disclosure, the first connecting chamber 2 and the second connecting chamber 3 are integrally mounted on a bracket. The bracket can be mounted on the wall body without any holes by the first connecting chamber 2 where the hole-free mounting component is mounted, and the second connecting chamber 3 is used for being connected to a traditional curtain, thus the technical problem in hole-free mounting of the traditional curtain is solved, hole-free mounting of the traditional curtain is achieved, and scrapping of the traditional curtains due to poor sales is avoided, therefore, resource wastes are reduced, production cost is cut down, and assembly and disassembly become more convenient and rapid.

It should be noted that, the above embodiments merely serve to explain the technical solutions of the present disclosure, but are not intended to limit thereto. Although this disclosure has been described in detail with reference to the above embodiments, it should be understood by those skilled in the art that many modifications on the technical solutions contained in the above embodiments or equivalent substitutions for partial technical features are possible. Further, these modifications or substitutions made will not cause the respective technical solutions to materially depart from the spirit and scope of the technical solutions disclosed by the above embodiments of the present disclosure.

I claim:

1. A curtain mounting bracket, comprising a body, wherein the body is provided with a first connecting chamber where a hole-free mounting component is installed and a second connecting chamber where a traditional curtain is connected, the body has an elongated shape extending in a length direction, and both the first and second connecting chambers penetrate through the body along the length direction;

wherein the hole-free mounting component comprises: a connecting base with a rear end surface, a front end surface, and a periphery, wherein the rear end surface is inwardly provided with an accommodation cavity, the front end surface is inwardly provided with a mounting hole communicated with the accommodation cavity, and the periphery has a plurality of convex ridges extending along the length direction for insertion into the first connecting chamber; a telescopic tube comprising a periphery, a front end and a rear end, wherein the periphery has external threads and the front end stretches into the accommodation cavity; an elastic element accommodated in the accommodation cavity comprising two ends and an inner bottom surface, wherein the two ends abutting against the front end of the telescopic tube and the inner bottom surface of the accommodation cavity separately; a locking ring of an annular shape, wherein the locking ring sheathes the periphery of the telescopic tube and comprises a central hole with an inner side wall, the inner sidewall of a central through hole of the locking ring is provided with internal threads meshed with the external threads; and a mounting plate connected to the rear end of the telescopic tube.

2. The curtain mounting bracket of claim 1, wherein the second connecting chamber comprises a bottom and is provided with an elongated slot at the bottom, and the elongated slot penetrates through both ends of the second connecting chamber along the length direction.

3. The curtain mounting bracket of claim 2, wherein the elongated slot has a width, the second connecting chamber has a width, and the width of the elongated slot is less than that of the second connecting chamber.

4. The curtain mounting bracket of claim 1, wherein the second connecting chamber has a bottom and is provided with at least one track groove for screw installation at the bottom, and the at least one track groove penetrates through both ends of the second connecting chamber along the length direction.

5. The curtain mounting bracket of claim 4, wherein the second connecting chamber comprises two track grooves at two sides of a central line of the second connecting chamber symmetrically.

6. The curtain mounting bracket of claim 1, wherein two sliding grooves communicated with the accommodation cavity, are provided at the periphery of the connecting base along the length direction and the two sliding grooves are arrayed in symmetry; there are two sliders that are matched with the sliding grooves in shape and opposite to the sliding grooves, at the periphery of the front end of the telescopic tube and the two sliders are embedded into the sliding grooves respectively.

7. The curtain mounting bracket of claim 1, wherein a bi-lug structure comprising two lugs is provided on the rear end surface of the telescopic tube, and two square grooves are formed on the mounting plate in a penetrated manner; the two lugs of the bi-lug structure stretch into the square grooves and are hinged with the mounting plate through a pin roll.

8. The curtain mounting bracket of claim 1, wherein the second connecting chamber is provided with an elongated slot at the bottom, and the elongated slot penetrates through both ends of the second connecting chamber along the length direction of the second connecting chamber.

9. The curtain mounting bracket of claim 8, wherein the elongated slot has a width less than that of the second connecting chamber.

10. The curtain mounting bracket of claim 1, wherein the second connecting chamber is provided with at least one track groove for screw installation at the bottom, and the at least one track groove penetrates through both ends of the second connecting chamber along the length direction of the second connecting chamber.

11. The curtain mounting bracket of claim 10, wherein the second connecting chamber comprises two track grooves are provided at two sides of a central line of the second connecting chamber symmetrically.

* * * * *